US009968146B2

(12) United States Patent
Dubose

(10) Patent No.: US 9,968,146 B2
(45) Date of Patent: May 15, 2018

(54) GUARD ACCESSORY FOR PANTS

(71) Applicant: Francwau Dubose, Columbus, OH (US)

(72) Inventor: Francwau Dubose, Columbus, OH (US)

( * ) Notice: Subject to any disclaimer, the term of this patent is extended or adjusted under 35 U.S.C. 154(b) by 94 days.

(21) Appl. No.: 15/157,614

(22) Filed: May 18, 2016

(65) Prior Publication Data

US 2016/0338434 A1 Nov. 24, 2016

Related U.S. Application Data

(60) Provisional application No. 62/163,795, filed on May 19, 2015.

(51) Int. Cl.
*A41D 27/14* (2006.01)

(52) U.S. Cl.
CPC ..... *A41D 27/145* (2013.01)

(58) Field of Classification Search
CPC ..... A41D 27/145; A41D 27/10; A41D 27/12; A41C 13/1227; A41C 13/001
USPC ..... 2/232, 231, 233, 901, 911, 59, 60, 2.12
See application file for complete search history.

(56) References Cited

U.S. PATENT DOCUMENTS 2,869,138 A * 1/1959 Hankoff ..... A41D 1/06 2/232
5,381,557 A * 1/1995 Luria ..... A01M 1/14 2/16
5,682,616 A * 11/1997 Pisano ..... A41B 11/00 2/16
7,225,470 B1 * 6/2007 Bradford ..... A41D 13/0005 2/2.11
7,434,270 B1 * 10/2008 Bradford ..... A41D 13/0005 2/159
8,726,417 B2 * 5/2014 McLachlan ..... A41D 13/0005 2/160
2010/0251459 A1 * 10/2010 Schlesinger ..... A41F 17/02 2/232

* cited by examiner

*Primary Examiner* — Gloria Hale
(74) *Attorney, Agent, or Firm* — Miracle IP; Bryce D. Miracle

(57) ABSTRACT

Disclosed herein is a protective guard accessory for protecting the cuff of a pant leg. In a version of the invention, the clothing accessory generally comprises a cuff protection sleeve comprising an annular wall portion with an upper enlarged portion and an inwardly curved bottom lip defining a circular channel. The circular channel adapted to receive a respective bottom cuff of the pants. In addition, an inner fastening ring is provided comprising an external annular channel configured to couple with the upper enlarged portion of the cuff protection sleeve. Wherein, while in use, the fabric of the pants is pinched or sandwiched between the top enlarged portion of the cuff protection sleeve and the inner fastening ring while simultaneously engaging the cuff within the circular channel. Thereby, engaging the clothing accessory with the lower end portion and bottom cuff of the respective pant leg and providing a barrier between the pant leg and respective shoe.

6 Claims, 5 Drawing Sheets

GUARD ACCESSORY FOR PANTS

This application is based upon and claims the priority filing date of the previously filed, U.S. Provisional patent application entitled "TROUSER CLOTHING ACCESSORY" filed May 19, 2015, Ser. No. 62/163,795, the entire disclosure of which is hereby incorporated herein by reference.

BACKGROUND

This invention relates generally to the field of clothing accessories and, more particularly, to the field of devices to be attached to the cuff of a pair of pants.

Those who wear dyed clothing, and blue jeans in particular, with white sneakers are well-acquainted with the problem of dye running from jeans or pants onto their shoes or sneakers. Currently, there is not an accessory that provides a barrier between the jean cuff and the shoe that does not itself include a runny dye.

Currently, no such accessory is available, and the next best solution to runny dye is to wash new clothes before wearing them. The wash-before-wearing technique is inconvenient since washing clothes takes time, energy, and money, and any of which, depending on the user's lifestyle, may be in short supply. Additionally, the wash-before-wearing technique may not succeed completely in removing all of the dye that will come from new clothing, thereby allowing the user's shoes to be damaged anyway.

The present invention provides an apparatus for reducing these problems. The difficulties inherent in the art are therefore overcome in a way which is simple, user friendly, and efficient—which will provide better and more advantageous results.

SUMMARY

Therefore, for the foregoing reasons, what is needed is to provide a protective guard accessory that attaches to the ends of pant legs which protects the pant leg ends from damage and protects the user's shoes from the pants' dyes. Moreover, the clothing accessory can display a decorative design to enhance the stylistic appeal of a pair of pants enabling the wearer to demonstrate personal style.

With that said, a clothing accessory for use with a pair of pants having two leg portions with each leg portion terminating at a bottom cuff is provided. The clothing accessory generally comprises a cuff protection sleeve comprising an annular wall portion with an upper enlarged portion and an inwardly curved bottom lip defining a circular channel. The circular channel adapted to receive a respective bottom cuff of the pants. In addition, an inner fastening ring is provided comprising an external annular channel configured to couple with the upper enlarged portion of the cuff protection sleeve. Wherein, while in use, the fabric of the pants is pinched or sandwiched between the top enlarged portion of the cuff protection sleeve and the inner fastening ring while simultaneously engaging the cuff within the circular channel. Thereby, engaging the clothing accessory with the lower end portion and bottom cuff of the respective pant leg and providing a barrier between the pant leg and respective shoe.

Still other benefits and advantages of the invention will become apparent to those skilled in the art to which it pertains upon a reading and understanding of the following detailed specification.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
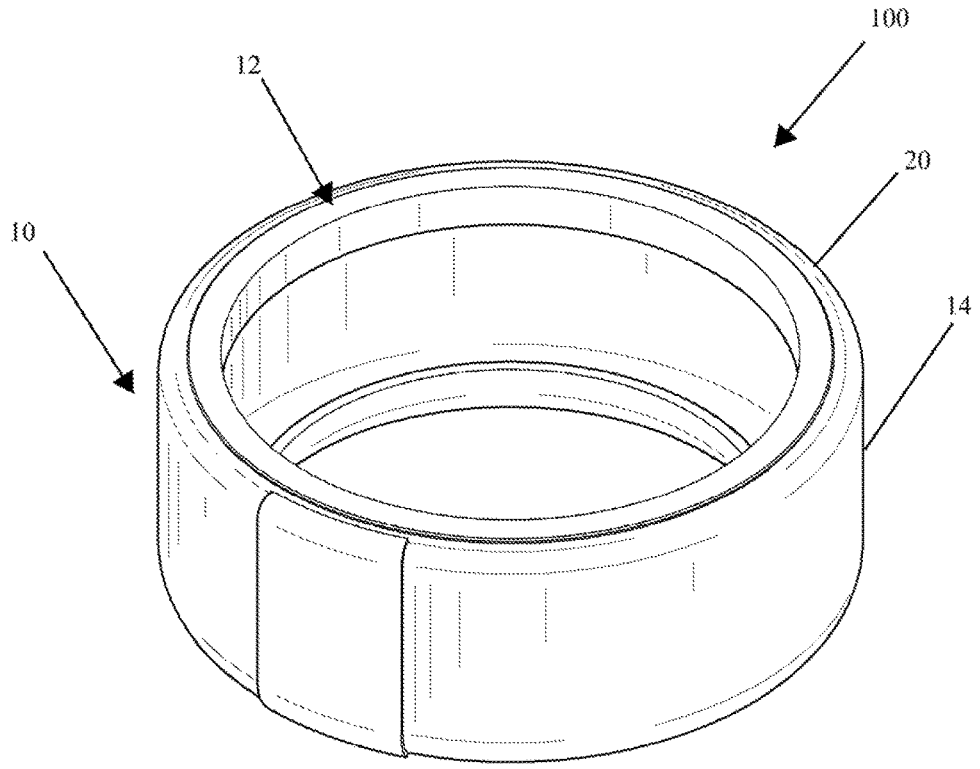
FIG. 1 is an assembled perspective view of a version of the present invention.
Figure 2:
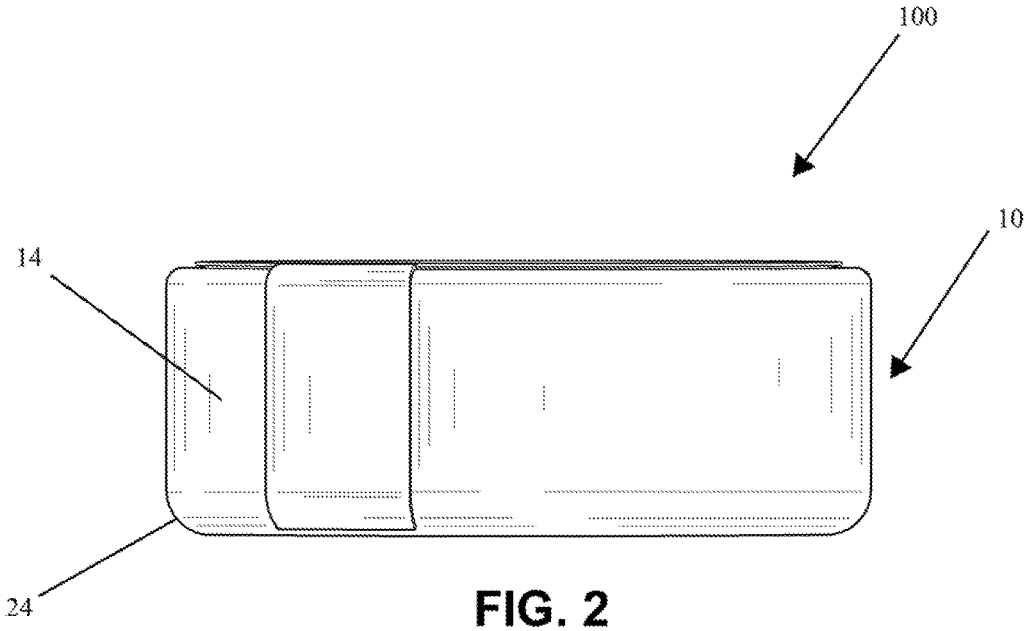
FIG. 2 is front elevation view of the version shown in FIG. 1.
Figure 3:
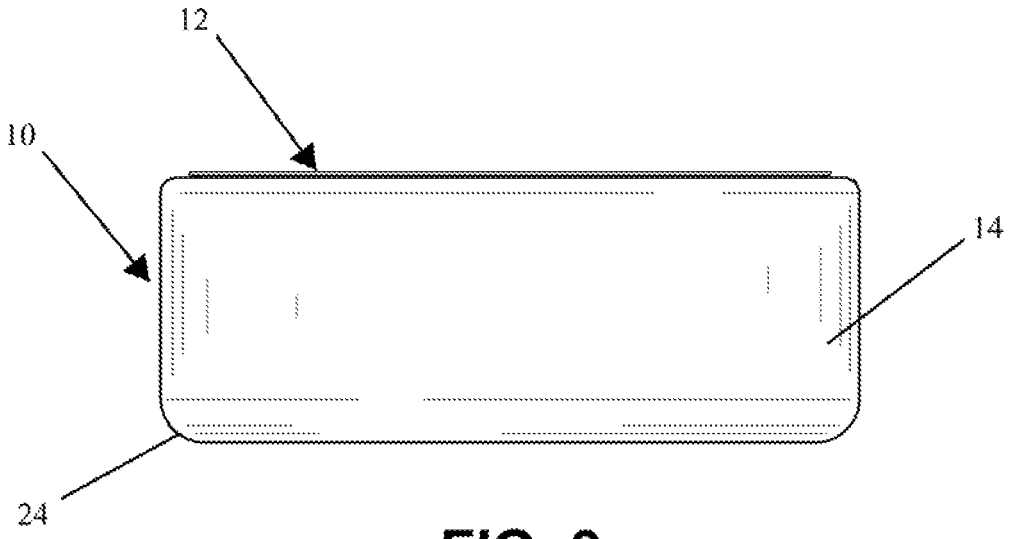
FIG. 3 is rear elevation view of the version shown in FIG. 1.
Figure 4:
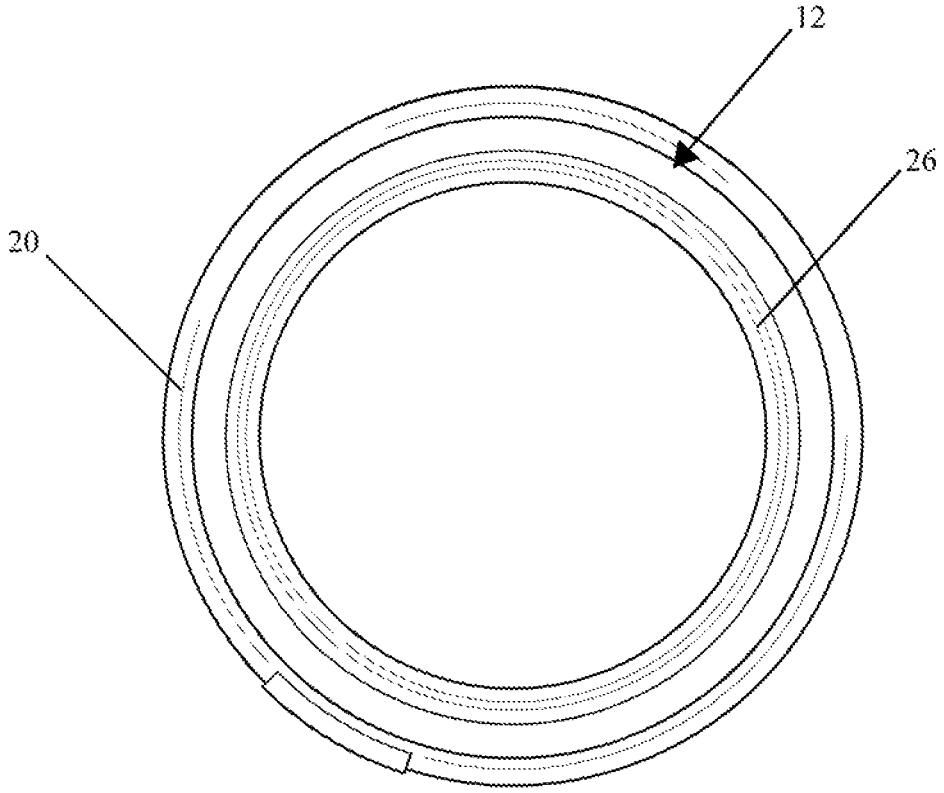
FIG. 4 is a top plan view of the version shown in FIG. 1.
Figure 5:
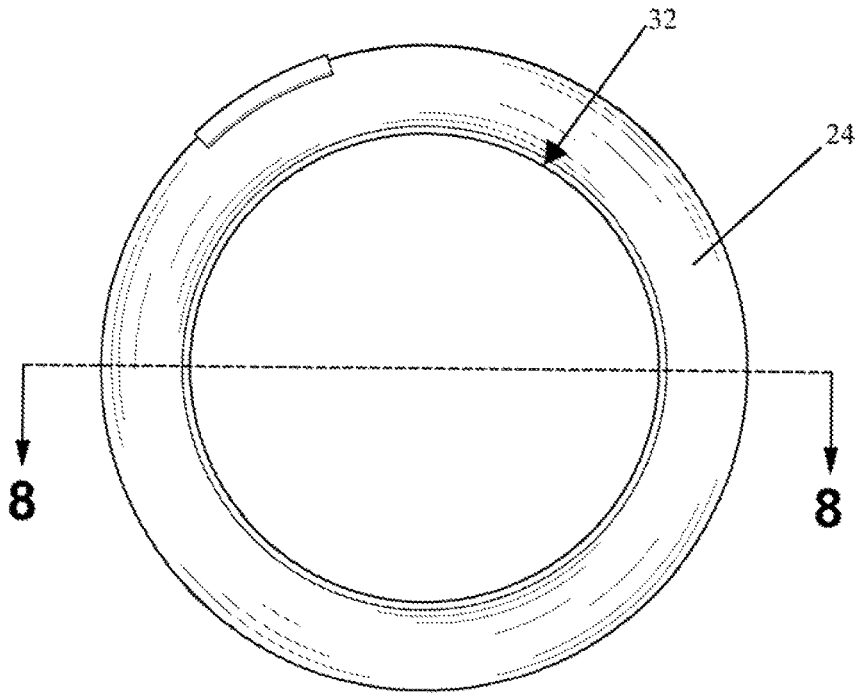
FIG. 5 is a bottom plan view of the version shown in FIG. 1.

Referring now to the drawings wherein the showings are only for purposes of illustrating a preferred version of the invention and not for purposes of limiting the same.

The following detailed description is of the best currently contemplated modes of carrying out exemplary versions of the invention. The description is not to be taken in the limiting sense, but is made merely for the purpose of illustrating the general principles of the invention, since the scope of the invention is best defined by the appended claims.

Various inventive features are described below that can each be used independently of one another or in combination with other features.

Attention is directed to FIG. 1-FIG. 9 of the drawings, wherein a clothing accessory is shown in accordance with a first version of the present invention and is shown in use and designated generally by reference numeral 100. The clothing accessory 100 is intended for use with a pair of pants 06 (FIG. 7-FIG. 8) having two legs 04 terminating at a lower end 03 which includes a bottom cuff 02. The pants may be of any style of design for men, women, boys, girls or even animals. The most benefit is derived when the clothing accessory 100 is applied to pants of a type most likely to be worn with white shoes and constructed of materials that tend to include runny dyes.

Figure 6:
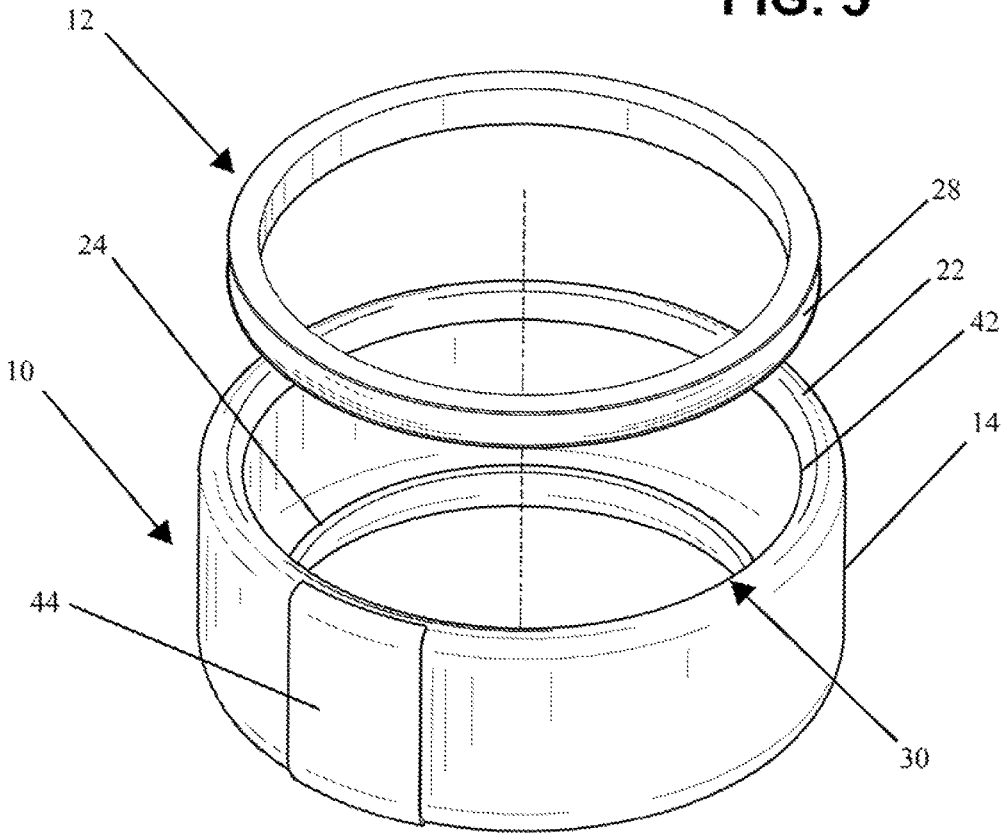
FIG. 6 is an unassembled perspective view of the version shown in FIG. 1.
Figure 8:
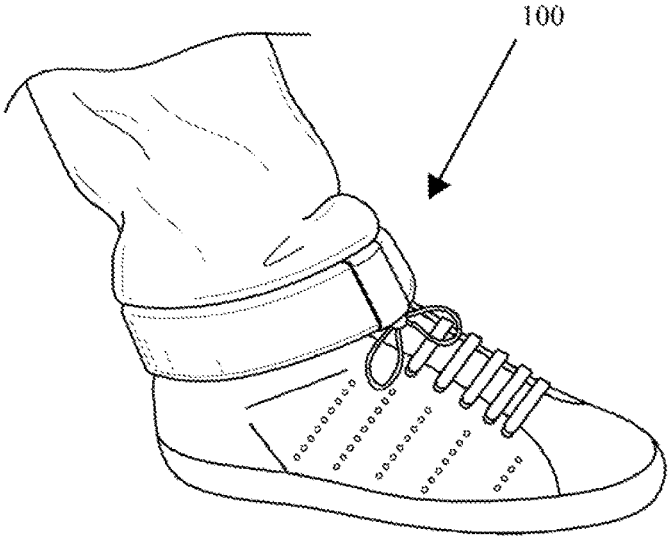
FIG. 8 is an up-close illustrative depiction of use of the version shown in FIG. 1.
Figure 9:
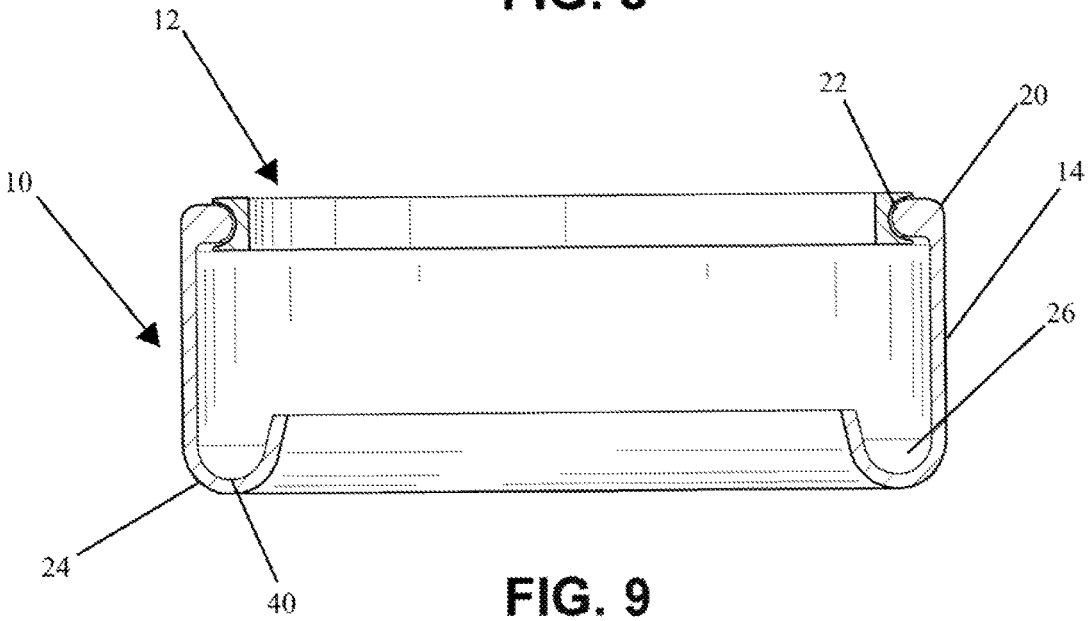
FIG. 9 cross sectional view taken along lines 8-8 of FIG. 5.

As best illustrated by FIG. 6, the clothing accessory 100 generally comprises a cuff protection sleeve 10 and an engaging inner fastening ring 12. In particular, as best illustrated by FIG. 1, the inner fastening ring is rigid in nature and attaches to the cuff protection sleeve near the upper opening 30. The clothing accessory is adapted to create a sufficient and comfortable barrier between the user's bottom pant cuff and their respective shoe (FIG. 8).

In a first version, the cuff protection sleeve 10 comprises a generally flexible annular wall portion 14. The flexible annular wall portion 14 forms a generally cylindrical shape having an inner chamber 34 with a consistent constant diameter. The diameter width is configured to sufficiently encompass a user's lower leg or ankle portion coordinating with the diameter of the pants' bottom cuff 02. The cuff protection sleeve 10 inner chamber 34 opens at each end with an upper opening 30 and a lower opening 32. In the version, the diameter of the upper opening 30 is larger than the diameter of the lower opening 32 for reasons detailed below.

The perimeter of the upper opening 30 is formed by an upper enlarged portion 20 which is integral with the annular wall portion 14. In the version, the upper enlarged portion 20 is a upper curved annular lip 22 extending inward and downward and integral from the annular wall portion 14 forming an inner curved rim 42. The perimeter of the lower opening 32 is formed by a bottom lip 24 curving inwardly and upwardly from the annular wall portion 14 defining an upward facing circular channel 26 adapted to receive a respective bottom cuff 02 of the pants 06. In the version, the diameter of the upper opening 30 is substantially similar and aligned vertically to the center 40 of the curved circular channel 26 in order to properly seat the cuff 02 directly below the perimeter of the upper opening 30. Thus, the diameter of the lower opening 32 tends to be smaller than the diameter of the upper opening in order to accommodate the width of the curved circular channel 26. In other versions, the bottom portion may be shaped in various ways to achieve the purpose of forming a channel for receipt of the cuff 02.

The cuff protection sleeve 10 can be made from any material using sound engineering judgment or combination of materials. Ideally, the cuff protection sleeve 10 is made from a soft silicone or an elastic material providing flexibility therein. Inherent flexibility is also favorable for enduring forces and impacts, thereby minimizing injury to the user's leg. However, other more rigid materials may be utilized such as plastics, polymers, composites and metals.

The inner fastening ring 12 comprises an external annular channel 28. The external annular channel 28 is configured to couple with the upper enlarged portion 20 or more particularly the upper curved annular lip 22 of the cuff protection sleeve 10. The inner fastening ring 12 can be made from any material using sound engineering judgment. Preferably, the inner fastening ring 12 is rigid in nature and can be made of plastic or a polymer material. Ideally, the inner fastening ring 12 is made of a more rigid material than the cuff protection sleeve 10. If a more rigid material is utilized, when engaged with the cuff protection sleeve 10, the inner fastening ring 12 provides a supporting structure or circular rib. Thus, providing strength and shape to the overall structure, particularly while being worn.

The use of the clothing accessory 100 will now be described in detail. The user positions the inner fastening ring 12 around their ankle and inside the lower end 03 of a respective pant leg 04. The cuff protection sleeve 10 is then positioned around the user's ankle, yet exterior of the lower end 03 of the respective pant leg 04. The bottom cuff 02 is then coupled to fit annularly within the circular channel 26 defined by the curved bottom lip 24. Thereafter, the external annular channel 28 of the inner fastening ring 12 is positioned to engage with the upper enlarged portion 20 and the upper curved annular lip 22, simultaneously pinching or sandwiching the flexible fabric of the lower end 03 portion (above the bottom cuff 02) of the respective pant leg 04 therebetween. Thereby, securing the clothing accessory to the lower end 03 and bottom cuff 02 of the respective pant leg 04 (See FIG. 7-9).

Figure 7:
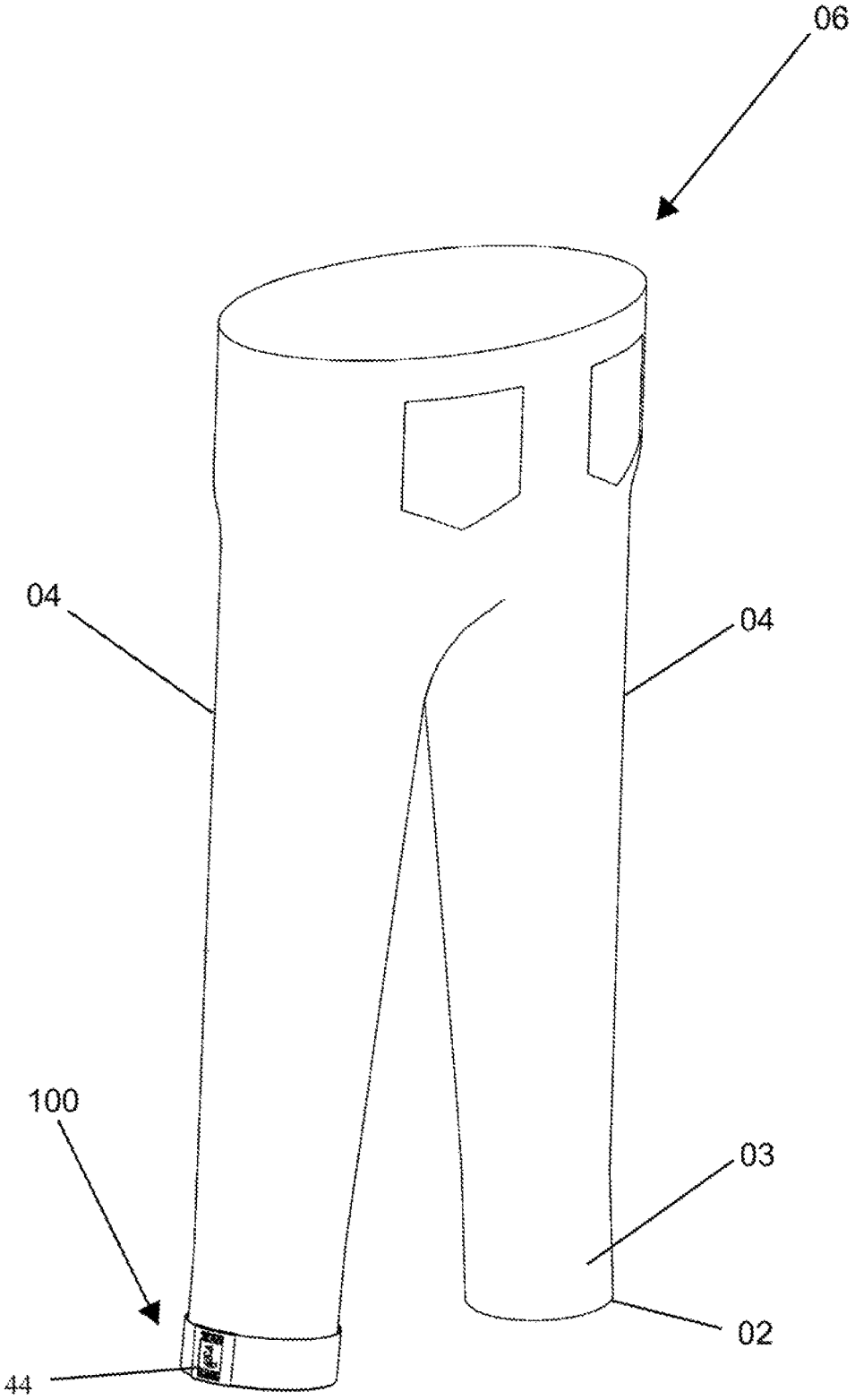
FIG. 7 is an illustrative depiction of use of the version shown in FIG. 1.

As illustrated in FIG. 7, the clothing accessory 100 may include the ability to boast a decorative design 44 or a logo of a favorite sports team.

The invention does not require that all the advantageous features and all the advantages need to be incorporated into every version of the invention.

Although preferred versions of the invention have been described in considerable detail, other versions of the invention are possible.

All the features disclosed in this specification (including and accompanying claims, abstract, and drawings) may be replaced by alternative features serving the same, equivalent or similar purpose unless expressly stated otherwise. Thus, unless stated otherwise, each feature disclosed is one example only of a generic series of equivalent or similar features.

What is claimed is:

1. A clothing accessory for use with pants having at least a leg portion terminating at a bottom cuff, comprising:

(a) a cuff protection sleeve forming a cylindrical chamber having an upper opening having a first diameter and a lower opening having a second diameter, the cuff protection sleeve comprising an annular wall portion, an upper curved annular lip extending inward and integral with the annular wall portion and forming the upper opening, and bottom portion inwardly extending and integral from the annular wall portion defining an upward facing circular channel adapted to receive the bottom cuff of the leg portion and forming the lower opening; and (b) a rigid inner fastening ring comprising an external annular channel configured to couple with the upper curved annular lip, whereby the clothing accessory attaches to the leg portion by squeezing the leg portion between the upper curved annular lip and the rigid inner fastening ring forming a tight fit.

2. The clothing accessory of claim 1, wherein the annular wall portion is made of a flexible material.

3. The clothing accessory of claim 1, wherein the bottom portion is a curved bottom lip extending inward and upward from the annular wall portion forming a curved circular channel for seating the bottom cuff.

4. The clothing accessory of claim 3, wherein the first diameter of the upper opening is larger than the second diameter of the lower opening.

5. The clothing accessory of claim 1, wherein the first diameter of the upper opening is larger than the second diameter of the lower opening.

6. A clothing accessory for use with pants having at least a leg portion terminating at a bottom cuff, comprising:

(a) a cuff protection sleeve forming a cylindrical chamber having an upper opening having a first diameter and a lower opening having a second diameter, the cuff protection sleeve comprising a flexible annular wall portion, an upper curved annular lip extending inward and integral with the annular wall portion and forming the upper opening, and a curved bottom lip inwardly and upwardly extending and integral with the flexible annular wall portion defining an upward facing curved circular channel adapted to receive a respective bottom cuff of the pants and forming the lower opening, wherein the first diameter of the upper opening is larger than the second diameter of the lower opening diameter; and (b) a rigid inner fastening ring comprising an external annular channel configured to couple with the upper curved annular lip, whereby the clothing accessory attaches to the bottom cuff of the leg portion by squeezing the leg portion between the upper curved annular lip and the rigid inner fastening ring forming a tight fit.

* * * * *